United States Patent [19]

Inoue et al.

[11] Patent Number: 4,907,952

[45] Date of Patent: Mar. 13, 1990

[54] TURBOCHARGER

[75] Inventors: Kazuo Inoue; Shunji Yano; Hideo Yamaji, all of Tokyo; Takayuki Hirayama; Masato Hayama, both of Saitama, all of Japan

[73] Assignee: Honda Giken Kogyo Kabushiki Kaisha, Tokyo, Japan

[21] Appl. No.: 128,632

[22] Filed: Dec. 4, 1987

[30] Foreign Application Priority Data

| | | | |
|---|---|---|---|
| Dec. 5, 1986 | [JP] | Japan | 61-291174 |
| Dec. 5, 1986 | [JP] | Japan | 61-291178 |
| Dec. 5, 1986 | [JP] | Japan | 61-291171 |
| Dec. 15, 1986 | [JP] | Japan | 61-298193 |
| Dec. 15, 1986 | [JP] | Japan | 61-298190 |

[51] Int. Cl.[4] ..... F04B 17/00

[52] U.S. Cl. ..... 417/407

[58] Field of Search ..... 417/405, 406, 407; 415/112, 150, 111

[56] References Cited

U.S. PATENT DOCUMENTS

| | | | |
|---|---|---|---|
| 2,582,916 | 1/1952 | Taub . | |
| 3,004,806 | 10/1961 | Schinnerer | 417/407 |
| 3,090,544 | 5/1963 | Woollenweber, Jr. et al. | 415/112 |
| 3,099,385 | 7/1963 | Elford | 417/407 |
| 4,107,927 | 8/1978 | Gordon, Jr. et al. . | |
| 4,196,910 | 4/1980 | Aizu | 415/111 |
| 4,376,617 | 3/1983 | Okano et al. | 417/407 |
| 4,685,869 | 8/1987 | Sasaki | 417/407 |
| 4,725,206 | 2/1988 | Glaser et al. | 417/407 |
| 4,735,556 | 4/1988 | Fujikake et al. | 417/407 |
| 4,780,054 | 10/1988 | Yano et al. | 415/150 |

FOREIGN PATENT DOCUMENTS

| | | | |
|---|---|---|---|
| 160243 | 11/1985 | European Pat. Off. . | |
| 58-32923 | 2/1983 | Japan | 417/407 |
| 58-178828 | 10/1983 | Japan . | |
| 60-45722 | 3/1985 | Japan | 417/407 |
| 60-128934 | 7/1985 | Japan | 417/407 |
| 201075 | 2/1938 | Switzerland . | |
| 248924 | 12/1944 | Switzerland . | |
| 968789 | 1/1963 | United Kingdom . | |
| 1092558 | 11/1967 | United Kingdom | 417/407 |
| 2126663 | 3/1984 | United Kingdom | 417/407 |

OTHER PUBLICATIONS

A.T.Z. Automobiltechnische Zeitschrift, vol. 86, No. 5, May 1984, Schwabisch GMUND, De F. Hauk et al.: "Der wassergekuhlte Abgasturbolader fur die aufgeladenen Audi Ottomotoren".

J. Mackerle: "Air-Cooled Motor Engines", 1961, SNTL-Publishers of Technical Literature, Prague, CS.

*Primary Examiner*—Louis J. Casaregola
*Assistant Examiner*—Timothy S. Thorpe
*Attorney, Agent, or Firm*—Lyon & Lyon

[57] ABSTRACT

A turbocharger comprises a compressor housing, a turbine housing, and a central housing with a shaft rotatably supported therein. The shaft supports on its respective opposite ends a compressor wheel and a turbine wheel that are rotatably disposed in the compressor housing and the turbine housing, respectively. The central housing has a large water jacket near the turbine housing and substantially coextensive therewith for storing cooling water to cool bearings which support the shaft. The turbine housing accommodates a shroud including a vane holder on which fixed and movable vanes are alternately supported for directing exhaust gases to the turbine wheel through variable restrictions. The vane holder or base plate has a radially outer flange and an annular boss which position the shroud axially and radially with respect to the central housing.

15 Claims, 8 Drawing Sheets

TURBOCHARGER

BACKGROUND OF THE INVENTION

The present invention relates to a turbocharger for use with automotive engines or the like, and more particularly to a turbocharger housing construction for a turbocharger having variable pitch inlet vanes.

Turbochargers for use with automotive engines include turbine and compressor wheels supported on and coupled by a shaft rotatably supported by bearings. Since clearances around the bearings are small and the heat of exhaust gases is transmitted from the turbine housing to the bearings, a large amount of lubricating oil is supplied to the bearings to lubricate and cool the bearings. When the engine is shut off, the supply of the lubricating oil is also stopped. Therefore, in the event of an engine shutdown during high-speed operation of the turbocharger, an unwanted phenomenon known as heat soak back is caused to burn and carbonize lubricating oil remaining around the bearings and in oil passages. The carbonized lubricating oil deposit will reduce the durability of the turbocharger.

To provide against the heat soak back phenomenon, there has been proposed a turbocharger having a water jacket in the vicinity of shaft bearings (see, for example, Japanese Laid-Open Utility Model Publications Nos. 58-124602, 61-35707, and 61-37791). In the proposed turbocharger, the heat remaining around the shaft bearings is removed by heat of vaporization of cooling water in the water jacket for thereby preventing remaining lubricating oil from being burned and carbonized at the time of heat soak back. As a result, the durability of the turbocharger is increased.

However, since oil supply and drain passages of relatively large cross-sectional areas for supplying and discharging lubricating oil are defined near the shaft bearings, the volume of the water jacket is small to avoid physical interference between the water jacket and the oil supply and drain passages. Under severe operating conditions, therefore, the shaft bearings may not be satisfactorily cooled by the limited amount of cooling water in the water jacket. In a recently proposed turbocharger with variable pitch inlet vanes, particularly, a mechanism for adjusting variable restrictions defined between fixed and movable vanes is positioned in the neighborhood of the shaft bearings, and hence a large space for the water jacket cannot be provided near the shaft bearings.

As disclosed in Japanese Patent Publication No. 38-7653, a known turbocharger with variable pitch inlet vanes includes an annular array of movable vanes disposed in a throat around a turbine wheel to provide variable restrictions for passage of exhaust gases therethrough. When an engine associated with the turbocharger operates in a low-speed range, the movable vanes are actuated to reduce the opening of the variable restrictions. Because the variable restrictions are defined between the movable vanes, however, the opening of the variable restrictions is greatly affected by even a small change in the angle of inclination of the movable vanes. As a result, the opening of the variable restrictions cannot accurately be controlled when the opening is relatively small.

There has been proposed a turbocharger capable of accurately controlling the opening of variable restrictions even when the opening is small, as disclosed in Japanese patent application Ser. No. 61-124996 filed May 30, 1986 by the present applicant. In the disclosed turbocharger, a turbine wheel is surrounded by a turbine housing including a top plate and a back plate, and fixed vanes are secured to the top plate and movable vanes are mounted on pins supported by the back plate. The fixed and movable vanes are disposed outside of and adjacent to a throat around the turbine wheel to provide variable restrictions for passage of exhaust gases.

The fixed vanes are attached to the top plate, and the movable vanes are supported on the back plate which is separate from the top plate. Consequently, it is difficult to accurately establish a gap or clearance between the ends of the movable vanes which are mounted on the pins and the fixed vanes due to an allowed assembling tolerance. With an improper clearance setting, the movable vanes may suffer malfunctioning, or the turbine efficiency may be lowered. The clearance should preferably be small in order to prevent an exhaust leakage for higher turbine efficiency. If the clearance were too small, however, the movable vanes would interfere with the fixed vanes when the top plate is heated, and the movable vanes would not smoothly be operated.

According to a turbocharger disclosed in Japanese Patent Publication No. 61-37791, compressor and turbine housings are joined by a central housing, and compressor and turbine wheels housed in the compressor and turbine housings are coupled by a shaft rotatably supported in the central housing. Inasmuch as the turbocharger operates at high temperature under the heat of exhaust gases, the housings are made of a heat-resistant material, and the central housing is cooled, to prevent seizure of the shaft. The turbine housing and the central housing are held in direct contact with each other through a relatively large area. Thus, the amount of heat transmitted from the turbine housing to the central housing is large. Since a relatively large tolerance is permitted when assembling the central and turbine housings together, the clearance between the turbine housing and the turbine wheel cannot accurately be controlled.

In the turbocharger disclosed in Japanese patent application Ser. No. 61-124996 referred to above, a base plate is fitted in the turbine housing and between the turbine and central housings, and the top plate is fixed to the base plate in the turbine housing in surrounding relation to the turbine wheel, which can be driven by exhaust gases applied thereto. Heat transfer to the central housing is prevented by the base plate. The top plate is disposed concentrically around the turbine wheel to define a clearance (nozzle) around the top plate and between the top plate and the turbine wheel and to accurately control the clearance.

The base plate fitted in the turbine housing has its outer peripheral surface held in intimate contact with an inner peripheral surface of the turbine housing. When the turbine housing is subjected to thermal strain due to the heat of exhaust gases, the base plate also suffers thermal strain, thus bringing the turbine wheel and the top plate out of concentricity. More specifically, the turbine housing is asymmetrically shaped because of a scroll passage defined therein for producing a swirl in the exhaust gases and an exhaust inlet opening tangentially into the scroll passage. The turbine housing therefore undergoes large localized thermal strain, and the top plate is brought largely out of concentricity due to its thermal strain. As a consequence, the turbine wheel and the top plate may interfere with each other, and the amount of exhaust gases leaking around the turbine wheel is increased thereby to lower the turbine efficiency.

Some turbochargers include an annular shroud disposed in a turbine housing which accommodates a turbine wheel. The turbine housing includes an exhaust passage for applying exhaust gases to the turbine wheel, the exhaust passage having an exhaust nozzle for speeding up the exhaust gases.

With a turbocharger having variable pitch inlet vanes, variable restrictions are defined by movable vanes and positioned in series with or independently of the exhaust nozzle. The movable vanes are tiltably disposed in the exhaust passage and slidably held against the shroud.

During operation of the turbocharger, the shroud is heated and deformed by the heat of exhaust gases, and the clearance of the exhaust passage, particularly the exhaust nozzle, is varied. The shroud which has thus suffered thermal strain is apt to interfere with the movable vanes, which may not be operated smoothly.

When the shroud is cooled and shrunk, a gap is created between the inner peripheral edge of the shroud and the central housing, allowing exhaust gases to leak through the gap.

SUMMARY OF THE INVENTION

It is an object of the present invention to provide a turbocharger having a water jacket for sufficiently cooling shaft bearings in a central housing under severe operating conditions thereby to increase the durability of the bearings.

Another object of the present invention is to provide a turbocharger having fixed and movable vanes defining variable restrictions for passage of exhaust gases, the fixed and movable vanes being supported on a vane holder with an accurate clearance between the supported ends of the movable vanes and walls of the fixed vanes, so that the turbine efficiency will not be lowered and the movable vanes will not be subjected to malfunctioning.

Still another object of the present invention is to provide a turbocharger having a housing assembly including a turbine housing constructed to prevent a top plate and a turbine wheel from being brought out of concentricity due to thermal strain of the turbine housing, so that the top plate will not interfere with the turbine wheel and the turbine efficiency will not be reduced.

A further object of the present invention is to provide a turbocharger having a housing assembly including a turbine housing having an exhaust nozzle for directing exhaust gases to a turbine wheel, the clearance of the exhaust nozzle being maintained to allow movable vanes to operate smoothly and to prevent exhaust gases from leaking.

According to the present invention, there is provided a turbocharger comprising a compressor housing accommodating a compressor wheel therein, a turbine housing accommodating a turbine wheel therein, the turbine housing having a scroll passage defined therein for directing engine exhaust gases toward the turbine wheel, a central housing disposed between and interconnecting the compressor and turbine housings, and a shaft rotatably supported in the central housing by bearings disposed therein, the compressor and turbine wheels being mounted on respective opposite ends of the shaft, the central housing having defined therein an oil supply passage for supplying lubricating oil to the bearings, an oil drain passage for discharging lubricating oil from the bearings, and a water jacket for storing cooling water to cool the bearings, and the water jacket having a radially outer wall radially extending at least to a substantially radially central portion of the scroll passage, the water jacket being defined more closely to the turbine housing than the oil supply and drain passages, the water jacket partly extending substantially fully around the bearings.

According to the present invention, there is also provided a turbocharger comprising a compressor housing accommodating a compressor wheel therein, a turbine housing accommodating a turbine wheel therein, the turbine housing having a scroll passage defined therein for directing engine exhaust gases toward the turbine wheel, a central housing disposed between and interconnecting the compressor and turbine housings, and a shaft rotatably supported in the central housing by bearings disposed therein, the compressor and turbine wheels being mounted on respective opposite ends of the shaft, the central housing having defined therein a water jacket for storing cooling water to cool the bearings, the water jacket having a volume selected such that the weight of the cooling water stored therein is at least 3% of the weight of the turbine housing.

According to the present invention, there is also provided a turbocharger comprising a compressor housing accommodating a compressor wheel therein, a turbine housing accommodating a turbine wheel therein, the turbine housing including a vane holder and a top plate secured to the vane holder, the vane holder and the top plate jointly defining a space in which the turbine wheel is positioned, the turbine housing having an exhaust inlet leading to the space, a central housing disposed between and interconnecting the compressor and turbine housings, a shaft rotatably supported in the central housing by bearings disposed therein, the compressor and turbine wheels being mounted on respective opposite ends of the shaft, and a plurality of alternate fixed and movable vanes disposed between the exhaust inlet and the space and defining a plurality of variable restrictions therebetween, the movable vanes being fixedly supported on pins rotatably extending through the vane holder and the fixed vanes being fixedly mounted on the vane holder.

According to the present invention, there is further provided a turbocharger comprising a compressor housing accommodating a compressor wheel therein, a turbine housing accommodating a turbine wheel therein, the turbine housing including an annular shroud disposed in surrounding relation to the turbine wheel, a central housing disposed between and interconnecting the compressor and turbine housings, a shaft rotatably supported in the central housing by bearings disposed therein, the compressor and turbine wheels being mounted on respective opposite ends of the shaft, and positioning means held in interfitting engagement with the shroud and the central housing for positioning the shroud with respect to the central casing.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
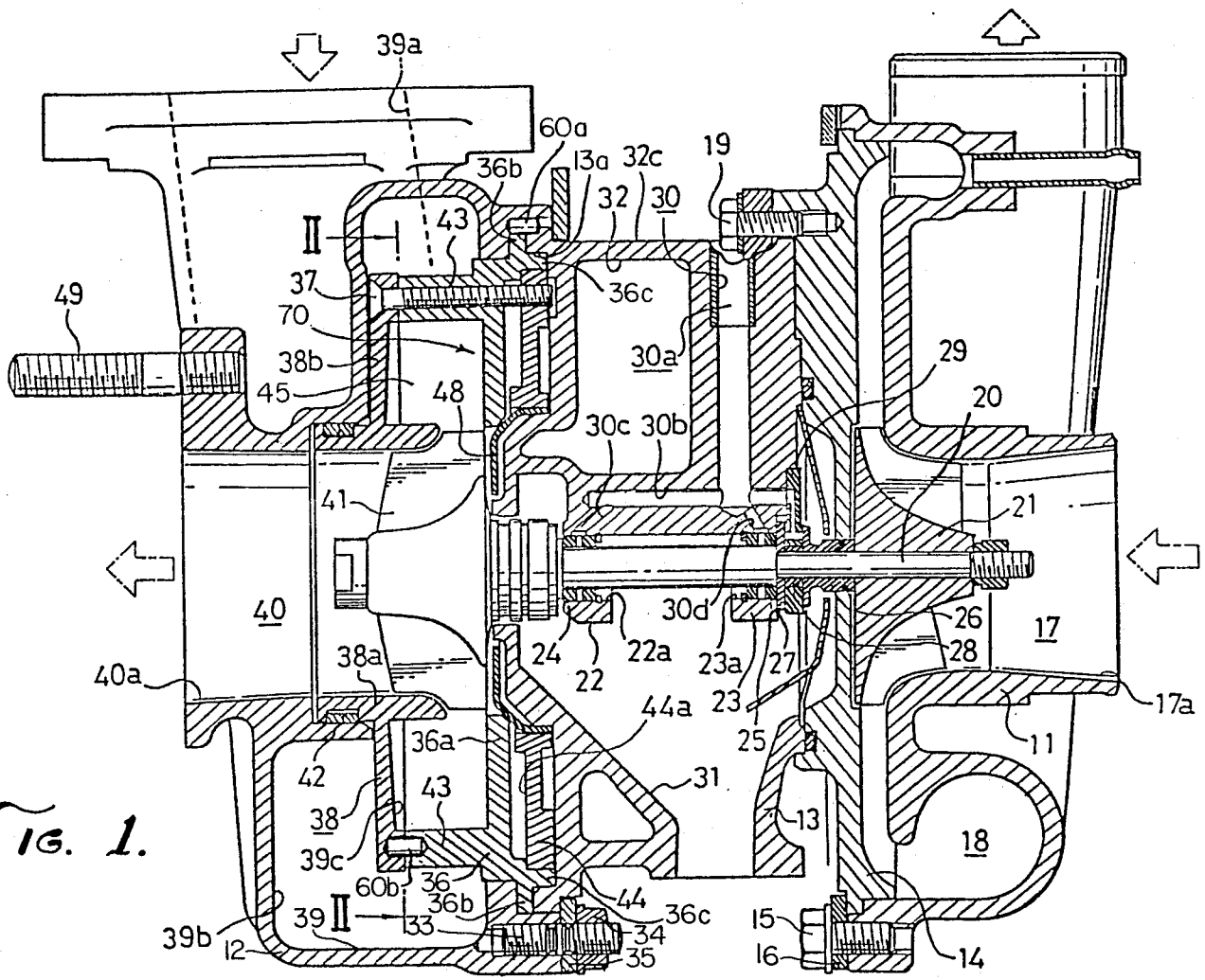
FIG. 1 is an axial cross-sectional view of a turbocharger according to the present invention.

Like or corresponding parts are denoted by like or corresponding reference numerals throughout several views.

As shown in FIG. 1, a turbocharger according to an embodiment of the present invention includes a turbocharger housing assembly comprising a compressor casing 11 accommodating a compressor wheel 21 therein, a turbine casing 12 accommodating a turbine wheel 41 therein, and a central casing or housing 13 in which there is rotatably supported a shaft 20 that interconnects the compressor wheel 21 and the turbine wheel 41. The compressor casing 11 and the turbine casing 12 are joined to each other by the central casing 13 located therebetween.

The compressor casing 11 has an open end (shown as a lefthand end in FIG. 1) to which a back plate 14 is secured by bolts 15 and an annular attachment plate 16, and defines therein an axial passage 17 and a scroll passage 18. The compressor back plate 14 is fastened to the central casing 13 by bolts 19. The compressor casing 11 and the compressor back plate 14 jointly constitute a compressor housing. The axial passage 17 has a lefthand end (FIG. 1) coupled to a central area of the scroll passage 18. The compressor wheel 21 which is supported on a righthand end of the shaft 20 and rotatably disposed in the area where the axial passage 17 and the scroll passage 18 are joined to each other. The axial passage 17 has a righthand open end **17*a* connected to an intake air inlet (not shown). The scroll passage 18** has an upper open end connected to an intake port leading to a combustion chamber (not shown) of an internal combustion engine.

The central casing 13 has two bearing supports 22, 23 axially spaced from each other and having respective bearing holes **22*a*, 23*a*. The shaft 20 is rotatably supported by float bearings 24, 25 disposed respectively in the bearing holes 22*a*, 23*a*. The righthand end of the shaft 20 extends rotatably through a bushing 26 into the compressor housing in which the shaft 20 is coupled to the compressor wheel 21, the bushing 26 being supported on the compressor back plate 14. A washer 27, a collar 28, and a thrust bearing 29 are interposed between a step of the shaft 20 and the bushing 26**.

The central casing 13 has an oil supply passage 30 defined therein above the bearing supports 22, 23 for supplying lubricating oil to the float bearings 24, 25, and an oil drain hole or passage 31 defined below the bearing supports 22, 23 for discharging lubricating oil downwardly. The oil supply passage 30 includes an oil inlet hole **30*a* having an open upper end, a lateral hole 30*b* communicating with the lower end of the oil inlet hole 30*a* and opening at a sliding surface of the thrust bearing 29, and two oil distribution holes 30*c*, 30*d* communicating with the lateral hole 30*b* and opening at peripheral surfaces of the bearing holes 22*a*, 23*a*, respectively. The open upper end of the oil inlet hole 30*a* is connected to a lubricating oil supply source (not shown) such as an oil pump. The oil drain passage 31 has an open lower end connected to an oil pan or the like (not shown). The oil supply passage 30 supplies lubricating oil from the lubricating oil supply source to the bearings 24, 25, 29 to lubricate and cool them, and the oil drain passage 31** discharges lubricating oil to the oil pan for reuse of the lubricating oil.

Figure 3:
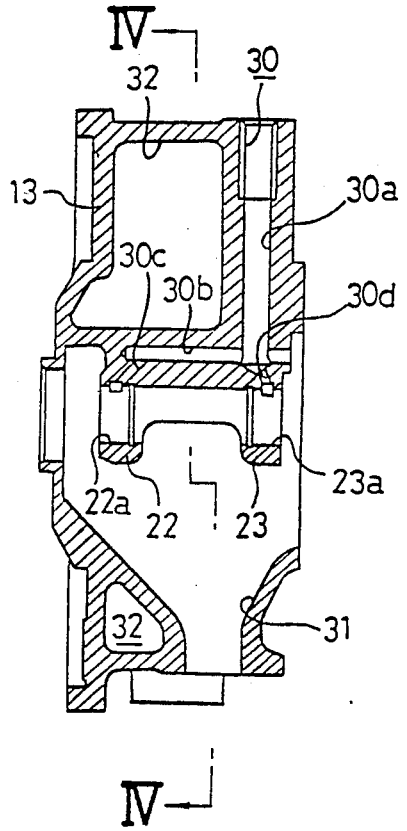
FIG. 3 is a cross-sectional view of a central casing of the turbocharger.
Figure 4:
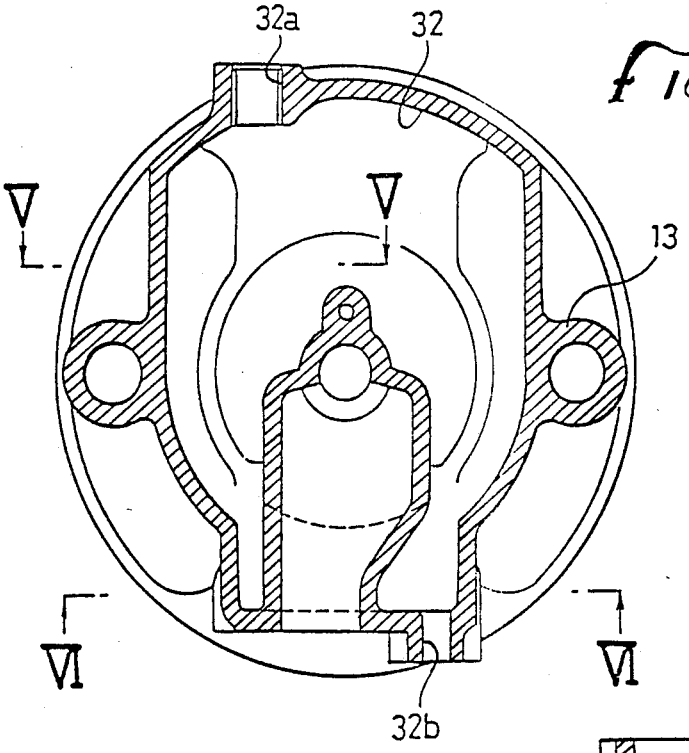
FIG. 4 is a cross-sectional view taken along line IV—IV of FIG. 3.
Figure 5:
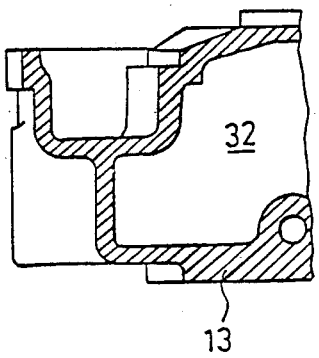
FIG. 5 is a cross-sectional view taken along line V—V of FIG. 4.
Figure 6:
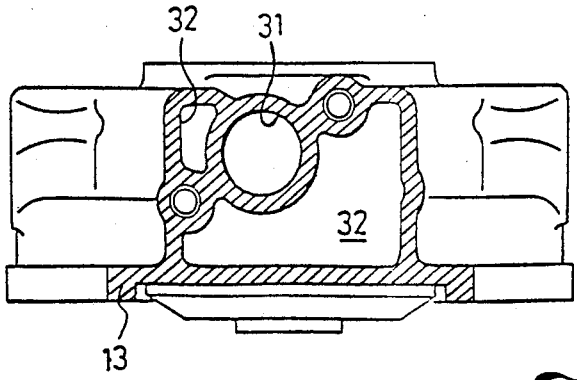
FIG. 6 is a cross-sectional view taken along line VI—VI of FIG. 4.

As also illustrated in FIGS. 3 through 6, the central casing 13 has a water jacket 32 which is defined therein more closely to the turbine casing 12 than the oil supply passage 30 and the oil drain passage 31 are. The water jacket 32 has a radially outer peripheral wall **32*c* located radially outwardly at substantially half of the radial width of a scroll passage 39 (described later) in the turbine casing 12. More specifically, the outer peripheral wall 32*c* is located radially outwardly at the radially outermost wall of an inner passageway 39*c* of the scroll passage 39, so that the water jacket 32 extends widely over an axial end surface of the turbine casing 12 which will be heated to a high temperature during operation of the turbocharger. As shown in FIG. 3, the inner wall surface of the water jacket 32 near the turbine casing 12 is substantially identical in shape and located closely to the outer wall surface of the central casing 13 near the turbine casing 12. As illustrated in FIGS. 4 through 6, a portion of the water jacket 32 close to the turbine casing 12 extends a substantial portion of around the bearing supports 22, 23. Stated otherwise, the water jacket 32 in the central casing 13 is of a large capacity, extending closely to the turbine casing 12, with the wall of the central casing 13 near the turbine casing 12 being of a small thickness. As shown in FIG. 4, the water jacket 32 has a lower water inlet 32*b* opening downwardly for introducing cooling water into the water jacket 32, and an upper water outlet 32*a* for discharging cooling water out of the water jacket 32. The water jacket 32 has a volume which is selected such that the weight of cooling water stored therein will be 3% or greater of the sum of the weights of top and base plates and the turbine casing 12, as will be described later on. The cooling water in the water jacket 32 is effective in preventing heat transfer from the turbine casing 12 to the bearing supports 22, 23. In case of heat soak back, the cooling water is vaporized to cool the bearing supports 22, 23** with heat of vaporization.

As shown in FIG. 1, stud bolts 33 are threaded into an end surface of the turbine casing 12, which is fixed to the central casing 13 by an attachment plate 35 that is fastened to the stud bolts 33 by nuts 34. The turbine casing 12 has a lefthand open end closed by a vane holder 36 (base plate) with its outer peripheral edge clamped between the turbine casing 12 and the central casing 13. A top plate 38 fixed to the vane holder 36 (base plate) by bolts 37 is disposed in the turbine casing 12. The turbine casing 12, the vane holder 36 (base plate), and the top plate 38 jointly constitute a turbine housing. The vane holder 36 (base plate) and the top plate 38 jointly define a space in which the turbine wheel 41 is positioned. The turbine casing 12 defines therein the scroll passage 39 and an outlet passage 40 connected centrally to the scroll passage 39. The turbine casing 12 also has an exhaust inlet **39*a* opening tangentially into the scroll passage 39. The outlet passage 40 has an exhaust outlet 40*a* opening at its lefthand end. The central area of the scroll passage 39 communicates with the righthand end of the outlet passage 40, and the turbine wheel 41 supported on the lefthand end of the shaft 20 is rotatably disposed in the area where the scroll passage 39 and the outlet passage 40** are joined to each other.

The top plate 38 comprises an inner cylindrical portion **38*a* fitted in an inner end of the outlet passage 40 with a seal ring 42 interposed therebetween, and a disc portion 38*b* integral with and extending radially outwardly from the outer peripheral surface of the inner cylindrical portion 38*a*. The turbine wheel 41 is rotatably positioned partly in the cylindrical portion 38*a* with a prescribed clearance therebetween. The disc portion 38*b* divides the scroll passage 39 into an outer passageway 39*b* and the inner passageway 39*c* (described above). The cylindrical portion 38*a* and the vane holder 36 (base plate) define therebetween a nozzle through which the inner passageway 39*c* opens toward the turbine wheel 41. The top plate 38 is fastened to the vane holder 36 by the bolts 37 which project from the turbine casing 12 through the disc portion 38*b* and the vane holder 36 (base plate) threadedly into a thermal insulation plate 44 turbine (back plate). The bolts 37 have projecting tip ends welded to the thermal insulation plate 44 (back plate) at its surface facing the central casing 13, so that the bolts 37** will not become loosened.

The vane holder 36 (base plate) comprises a disc portion **36*a* through which the shaft 20 rotatably extends, and four fixed vanes 43 (see also FIG. 2) extending from the outer periphery of the disc portion 36*a* axially toward the top plate 38. The disc portion 36*a* has a radially outward flange 36*b* and an annular boss 36*c* extending toward the central casing 13. The flange 36*b* is clamped between the turbine casing 12 and the central casing 13, whereas the boss 36*c* is fitted in a positioning recess 13*a* defined in the end surface of the central casing 13 which faces the compressor casing 12. The boss 36*c* has an outer peripheral surface held against an inner peripheral surface of the positioning recess 13*a*. The flange 36*b* has a side surface held against the corresponding end surface of the central casing 13. The thermal insulation plate 44 is fitted in the annular boss 36*c*, with a thermal insulation layer or gap 44*a* being defined between the thermal insulation plate 44 and the disc portion 36*a* for reducing heat transfer from the compressor housing to the central casing 13. The thermal insulation plate 44 (back plate) and the vane holder 36 (base plate) jointly serve as a shroud 70 positioned in the righthand open end of the turbine casing 12 and surrounding the shaft 20**.

The central casing 13 and the vane holder 36 are circumferentially positioned with respect to each other by means of a positioning knock pin **60*a*. Similarly, the vane holder 36 (base plate) and the top plate 38 are circumferentially positioned with respect to each other by means of a positioning knock pin 60*b***.

Figure 2:
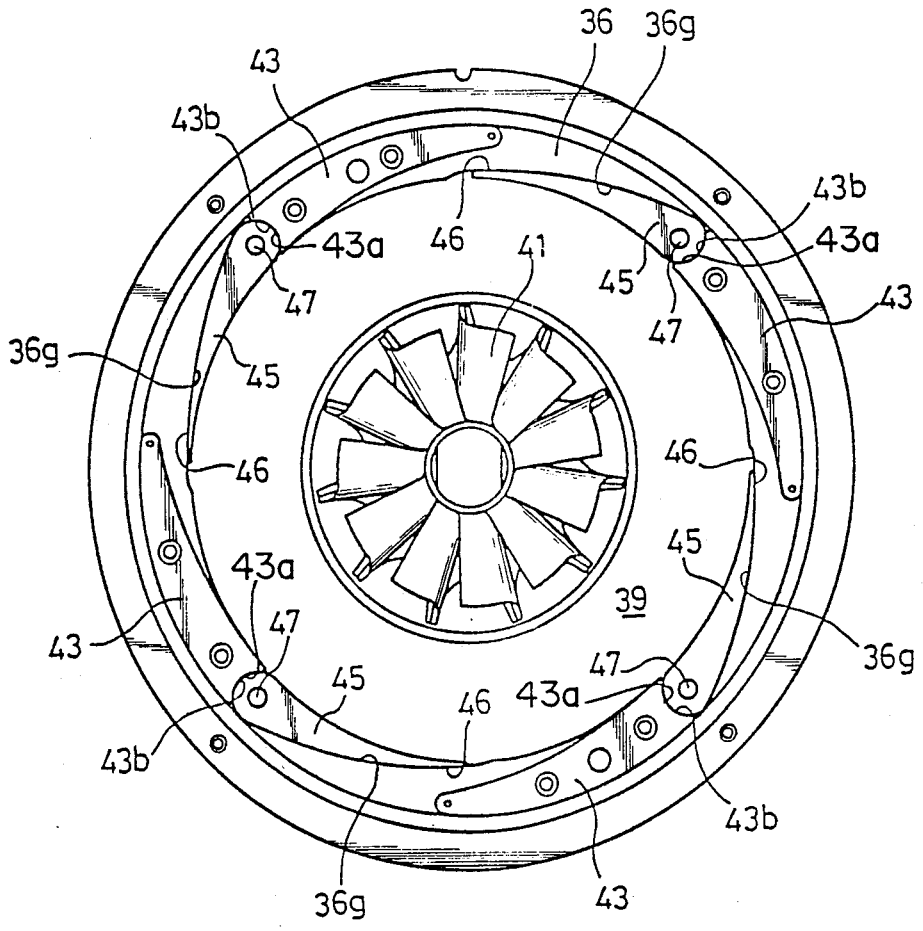
FIG. 2 is an elevational view taken along line II —II of FIG. 1.

As shown in FIG. 2, the fixed vanes 43 are arcuate in shape and circumferentially equally spaced in concentric relation to the turbine wheel 41. Between the fixed vanes 43, there are disposed four arcuate movable vanes 45 each between two adjacent fixed vanes 43. The fixed and movable vanes 43, 45 define four variable restrictions 46 communicating between the outer and inner passageways **39*b*, 39*c* of the scroll passage 39 for passage of exhaust gasses. Each of the movable vanes 45 has an arcuate end fixedly supported on a rotatable pin 47 axially inserted through a hole defined in the vane holder 36 (base plate) parallel to the shaft 20. Therefore, the movable vanes 45 are tilted to vary the cross-sectional areas (opening) of the variable restrictions 46 in response to rotation of the pins 47 about their own axes. The pins 47 have ends projecting toward the central casing 13 and operatively connected to an actuator (not shown) through a link mechanism disposed between the central casing 13 and the vane holder 36**. The link mechanism is described in detail in Japanese patent application Ser. No. 61-125000 filed by present applicant, and will not be described in detail.

In FIG. 2, the vane holder 36 has stepped walls **36*g* complementary in shape to the movable vanes 45 and serving as stoppers for the movable vanes 45, the stepped walls 36*g* being on its surface facing the top plate 38. The fixed vanes 43 have respective arcuate recesses 43*a* defined in their ends close to the supported arcuate ends of the movable vanes 45 and partly accommodating the supported ends of the movable vanes 45. The recesses 43*a* are defined by arcuate walls 43*b*, respectively, of the fixed vanes 43, the arcuate walls 43*b* being complementary in shape and concentric to the supported arcuate ends of the movable vanes 45, with a clearance (normally of about 0.1 mm) left between the supported ends of the movable vanes 45 and the arcuate walls 43*b*. The arcuate walls 43*b* are contiguous to the stepped walls 36*g* of the vane holder 36** (base plate).

Figure 7:
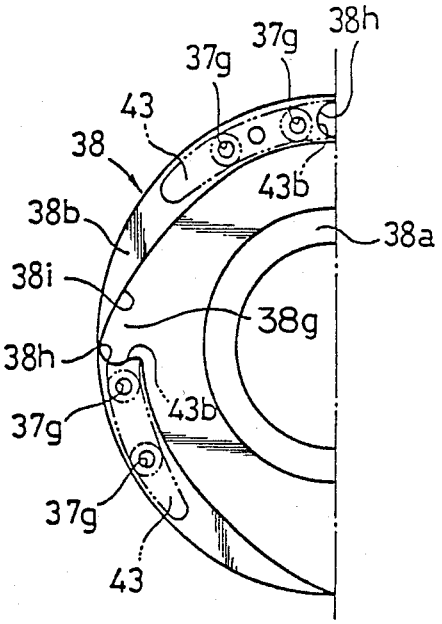
FIG. 7 is a fragmentary front elevational view of a top plate in the turbocharger.

As shown in FIG. 7, the top plate 38 has holes **37*g* through which the bolts 37 extend, and stepped relief portions 38*g* serving as stoppers for stopping the movable vanes 45. The stepped relief portions 38*g* are partly defined by respective stepped walls 38*h* extending along the circular outer edges of the supported ends of the movable vanes, there being a prescribed clearance (normally of about 0.25 mm) between the stepped walls 38*h* and the supported ends of the movable vanes 45. Therefore, the clearance between the stepped walls 38*h* and the supported ends of the movable vanes 45 is greater than the clearance between the arcuate walls 43*b* and the supported ends of the movable vanes 45. The stepped walls 38*h* are contiguous to respective stepped walls 38*i* of the top plate 38 which are complementary in shape to the movable vanes and serve as stoppers for the movable vanes 45**.

The movable vanes 45 are angularly movable by and about the pins 47 between a position in which the movable vanes 45 are held against the stepped walls **38*i* of the top plate 38 and the stepped walls 36*g* of the vane holder 36 for minimizing the opening of the variable restrictions 46 and a position in which the movable vanes 45 are positioned radially inwardly of the stepped walls 38***i*, 36*g* for maximizing the opening of the variable restrictions 46.

Referring back to FIG. 1, a disc-shaped shield or heat insulator 48 disposed between the turbine housing and the central casing 13 has an outer peripheral edge clamped between the inner peripheral edge of the thermal insulation plate 44 and an outer peripheral wall of the central casing 13. The shield 48 keeps the inner peripheral edge of the vane holder 36 (base plate) spaced from the central casing 13. Like the thermal insulation plate 44, the shield 48 also serves to reduce the heat of exhaust gases from being transferred from the turbine housing to the central casing 13. The turbine casing 12 can be installed on a suitable mount (not shown) by means of a stud bolt 49 with one end threaded in the turbine casing 12.

Operation of the turbocharger will be described below. When the speed of rotation of the engine is relatively low and the amount of exhaust gases emitted from the engine is small, the movable vanes 45 are positioned as shown in FIG. 2 to minimize the opening of the variable restrictions 46. Therefore, the exhaust gases introduced from the exhaust inlet 39*a* flow from the outer passageway 39*b* through the variable restrictions 46 into the inner passageway 39*c* at an increased speed, and swirl in the inner passageway 39*c* to drive the turbine wheel 41. Therefore, the compressor wheel 21 is rotated at a high speed to pressurize and charge intake air into the engine combustion chamber. Thus, the engine is well supercharged while it is operating at low speed.

When the speed of rotation of the engine is increased and so is the amount of exhaust gases emitted therefrom, the movable vanes 45 are angularly moved radially inwardly to increase the opening of the variable restrictions 46. The resistance to the flow of the exhaust gases is reduced, and so is the back pressure of the exhaust gases, without need for any special wastegate and control valve which would otherwise have to be combined with the turbocharger. The turbine wheel 41 is rotated by the exhaust gases to enable the compressor wheel 21 to pressurize and charge intake air into the engine.

During operation of the turbocharger, the float bearings 24, 25 and the thrust bearing 29 which support the shaft 20 in the central casing 13 are lubricated and cooled by lubricating oil supplied to the oil supply passage 30, and lubricating oil is thereafter discharged from the oil drain passage 31.

As described above, the water jacket 32 is defined in the central casing 13 on one side of the oil supply and drain passages 30, 31 which is near the turbine casing 12, and is partly disposed fully around the bearing supports 22, 23, so that cooling water in the water jacket 32 prevents the heat of exhaust gases in the turbine casing 12 from being transferred to the lubricating oil and the bearings 24, 25, 29. Therefore, the bearings 24, 25, 29 are prevented from being overheated. Since the water jacket 32 has the upper water outlet 32*a* and the water inlet 32*b*, hot water and cold water can efficiently be exchanged for increased cooling capability.

The water jacket 32 is of a large volume because it is substantially coextensive with the inner passageway 39*c* of the scroll passage 39 which is heated up to high temperature, and also because the inner wall surface of the water jacket 32 near the turbine casing 12 is substantially complementary to the outer wall surface of the central casing 13 near the turbine casing 12.

At the time of heat soak back, the cooling water in the water jacket 32 is vaporized to cool the central casing 13, i.e., the bearing supports 22, 23 with heat of vaporization. Since the volume of the water jacket 32 is selected such that the weight (Ww) of the cooling water in the water jacket 32 is 3% or more of the sum (Wa) of the weight (Wt) of the turbine casing 12, the weight (Wb) of the vane holder 36, and the weight (Wp) of the top plate 38, the lubricating oil remaining in the passages 30, 31 is prevented from being burned and carbonized, and hence the passages 30, 31 are prevented from being deteriorated by carbides. More specifically, when the turbocharger is in operation, the turbine casing 12 is heated up to about 750° C. and the vane holder 36 and the top plate 38 are heated up to about 850° C., and the turbine casing 12, the vane holder 36, and the top plate 38 store an amount of heat (Qo) indicated by the equation (1) given below. When the engine is stopped (i.e., at the time of heat soak back), about 40%, or about 43% in the case of the illustrated structure, of the stored amount of heat (Qo) is transmitted to the central casing 13 through the transmitted amount of heat may vary slightly dependent on the area of contact with the central casing 13. The transmitted heat is responsible for carbonizing the lubricating oil remaining in the passages 30, 31.

$$Qo = 750 \times Wt \times C + 850 \times (Wb + Wp) \times C \quad (1)$$

where the amount of heat (Qo) is indicated at 0 [° C.], and C is the specific heat (C=0.12) of general heat-resistant steel.

Inasmuch as the lubricating oil is prevented from being carbonized by keeping the temperature of the central casing 13 at 250° C. or below, the amount of heat (Q') to be removed by the heat of evaporation of the cooling water in the water jacket 32 is expressed by:

$$Q' = \{(750-250)Wt \times C + (850-250) \times (Wb + Wp) \times C\} \times 0.43 \quad (2)$$

Therefore, by using 430 [Kcal/Kg] for the heat of evaporation of the cooling water per unit weight and 0.12 [Kcal/Kg ° C.] for the specific heat (C), the weight (Ww) of the cooling water required to prevent the lubricating oil from being carbonized is given by the following equation (3):

$$\begin{aligned} W_w &= \frac{Q}{430} \\ &= \frac{25.8 \times Wt + 30.96 \times (Wb + Wp)}{430} \\ &> 0.06 \times (Wt + Wb + Wp) \end{aligned} \quad (3)$$

Thus, Ww>0.06 Wa. Consequently, where the weight (Wc) of the cooling water in the water jacket 32 is 6% or more of the total weight Wa of the turbine casing 12, the vane holder 36 (base plate), and the top plate 38, the lubricating oil is not heated beyond 250° C. and is prevented from being carbonized even at the time of heat soak back.

The weight (Ww) may be 3% or more of the sum weight (Wa) in view of the convective action of the cooling water, but should be 8% or less of the sum weight (Wa) in order to avoid an excessive increase in the size and weight of the turbocharger. The weight (Ww) of the cooling water should range from 3 to 8% of the sum weight (Wa), and preferably from 5 to 7% of the sum weight (Wa).

As described above, the fixed vanes 43 are integrally fixed to the end surface of the vane holder 36 near the top plate 38, and the movable vanes 45 are fixed to the respective pins 47 extending through the holes 37g defined in the vane holder 36. Therefore, the relative positions of the fixed vanes 43 and the movable vanes 45 are not affected by a tolerance developed when the parts of the turbocharger are assembled together, and the clearance between the fixed and movable vanes 43, 45 can accurately be established, and can also be adjusted easily at the time of assemblage. Therefore, the clearance can be set to an optimum value to minimize any exhaust gas leakage for thereby preventing the turbine efficiency from being lowered, and is also effective to avoid physical interference between the fixed and movable vanes 43, 45 when they are expanded due to heat, so that the movable vanes 45 can smoothly be operated.

As described with reference to FIG. 7, the relief recess portions 38g are defined in the top plate 38 at its end surface near the vane holder 36 (base plate) for guiding the movable vanes 45, and the relief portions 38g are partly defined by the stepped walls 38h spaced by a clearance from the outer peripheral surfaces of the supported ends of the movable vanes 45. The clearance between the stepped walls 38h and the supported ends of the movable vanes 45 is larger than the clearance between the arcuate walls 43b and the supported ends of the movable vanes 45. Therefore, even if the top plate 38 and the vane holder 36 (base plate) are assembled off desired relative positions due to an assembling tolerance, movable vanes 45 are held out of physical interference with the stepped walls 38h of the top plate 38, and are allowed to operate smoothly.

Figure 8:
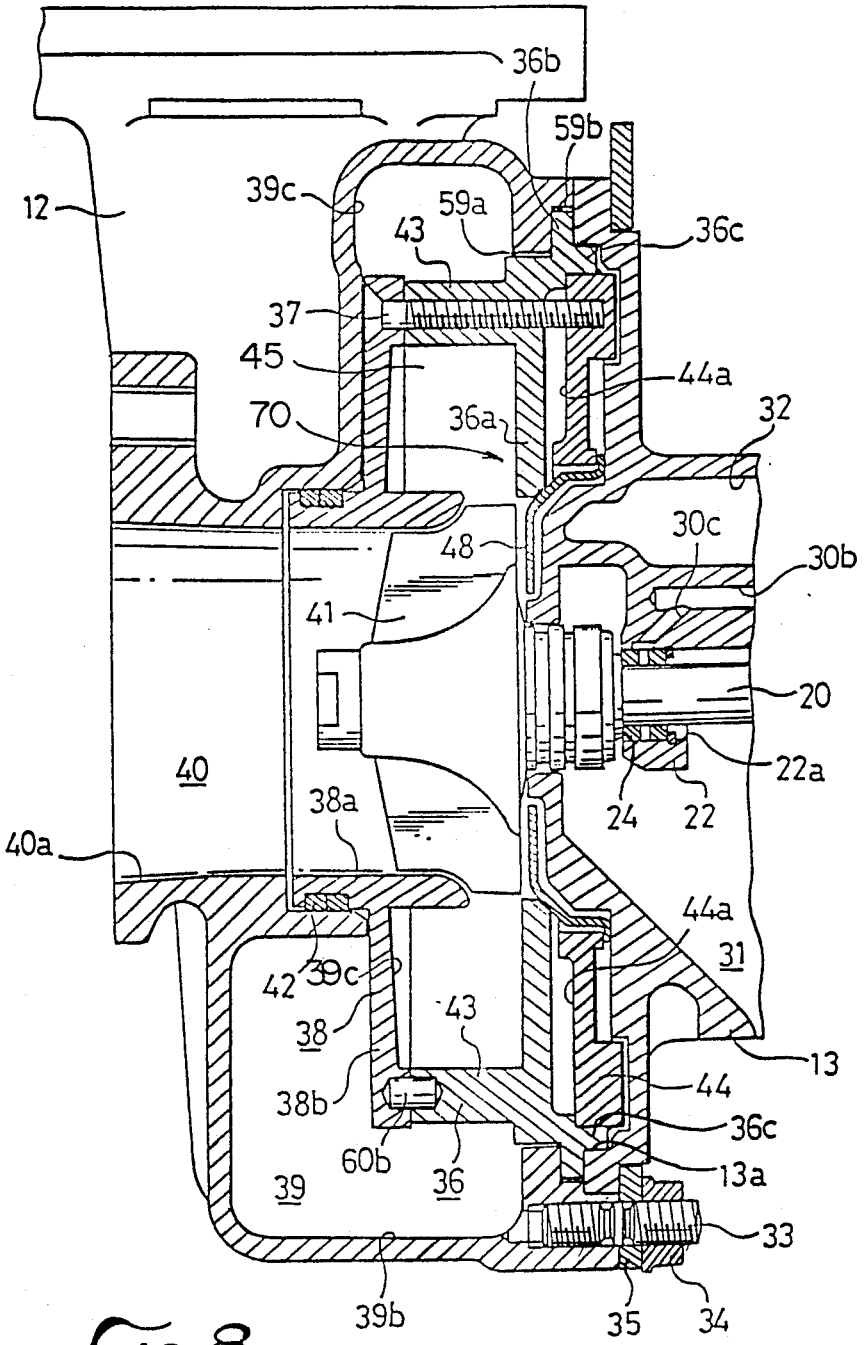
FIG. 8 is a fragmentary axial cross-sectional view of a turbocharger according to another embodiment of the present invention.

FIG. 8 shows a turbocharger according to another embodiment of the present invention. The turbocharger shown in FIG. 8 differs from the turbocharger of the previous embodiment in that the thermal insulation plate 44 (back plate) is welded at its outer peripheral edge to the annular boss 36c (base plate) of the vane holder 36, and there are a radial clearance 59a between an outer peripheral surface of the disc portion 36a and an inner peripheral surface of the turbine casing 12 and another radial clearance 59b between an outer peripheral surface of the flange 36b and another inner peripheral surface of the turbine casing 12.

There is a small clearance between the disc portion 38b and an inner wall surface of the turbine casing 12, and there is also a small clearance between the cylindrical portion 38a and an inner peripheral wall of the turbine casing 12.

The boss 36c (base plate) fitted in the positioning recess 13a serves to position the vane holder 36 concentrically and axially with respect to the central casing 13. In the embodiment of FIG. 8, the axial end surface of the boss 36c which faces the central casing 13 and the axial end surface of the thermal insulation plate 44 (back plate) facing the central casing 13 are held out of contact with the central casing 13.

During operation of the turbocharger shown in FIG. 8, the turbine housing is expanded by the heat of exhaust gases flowing through the scroll passage 39. Since the vane holder 36 (base plate) is securely positioned with respect to the central housing 13 by the boss 36c fitted in the positioning recess 13a, the vane holder 36 (base plate) and the top plate 38 fixed thereto are not positionally affected by the thermal expansion of the turbine housing. Therefore, even if the turbine housing is heated and expanded during operation, the clearance between the top plate 38 and the turbine wheel 41 can be maintained. More specifically, while the turbocharger is in operation, the central casing 13 is kept at a relatively low temperature (about 300° C. or below) by the lubricating oil and the cooling water therein, and hence is only subjected to a small thermal expansion (thermal strain). Consequently, the clearance between the turbine wheel 41 supported on the shaft 20 in the central casing 13 and the top plate 38 positioned by the vane holder 36 (base plate) with respect to the central casing 13 is substantially prevented from being varied. Therefore, the amount of exhaust gases leaking through the clearance between the top plate 38 and the turbine wheel 41 is not increased, thus keeping the turbine efficiency at a desired level. In addition, the top plate 38 and the turbine wheel 41 are free from physical interference which would otherwise be caused by an excessive reduction in the clearance between the top plate 38 and the turbine wheel 41, so that the turbine wheel 41 will operate reliably.

The turbine casing 12 which is asymmetrically shaped tends to suffer from localized thermal strain when heated. Such localized thermal strain is however absorbed by the clearances 59a, 59b between the vane holder 36 (base plate) and the turbine casing 12 and also by the clearance between the top plate 38 and the turbine casing 12. As a result, the top plate 38 and the vane holder 36 (base plate) are not subject to thermal strain which would otherwise result from the thermal strain of the turbine casing 12. This allows the movable vanes 45 to operate reliably and smoothly without being affected by unwanted thermal strain. Since the clearance between the top plate 38 and the turbine casing 12 is not adversely affected by the localized thermal strain of the turbine casing 12, the turbine efficiency is further prevented from being reduced and the turbine wheel 41 and the top plate 38 are further prevented from mutual physical interference. Moreover, the clearances between the movable vanes 45 and the vane holder 36 (base plate) and the top plate 38 are also not thermally affected. The exhaust leakage at the time the movable vanes 45 are positioned for minimizing the variable restrictions 46 is minimized thereby to prevent the turbine efficiency from being lowered.

For positioning the vane holder 36 (base plate) and the central casing 13 with respect to each other, the thermal insulation plate 44 (back plate) may be welded or otherwise secured directly to the central casing 13, or a heat insulator as in a compressor may be assembled in place and the thermal insulation plate 44 (back plate) may be fitted in the vane holder 36 (base plate).

Figure 9:
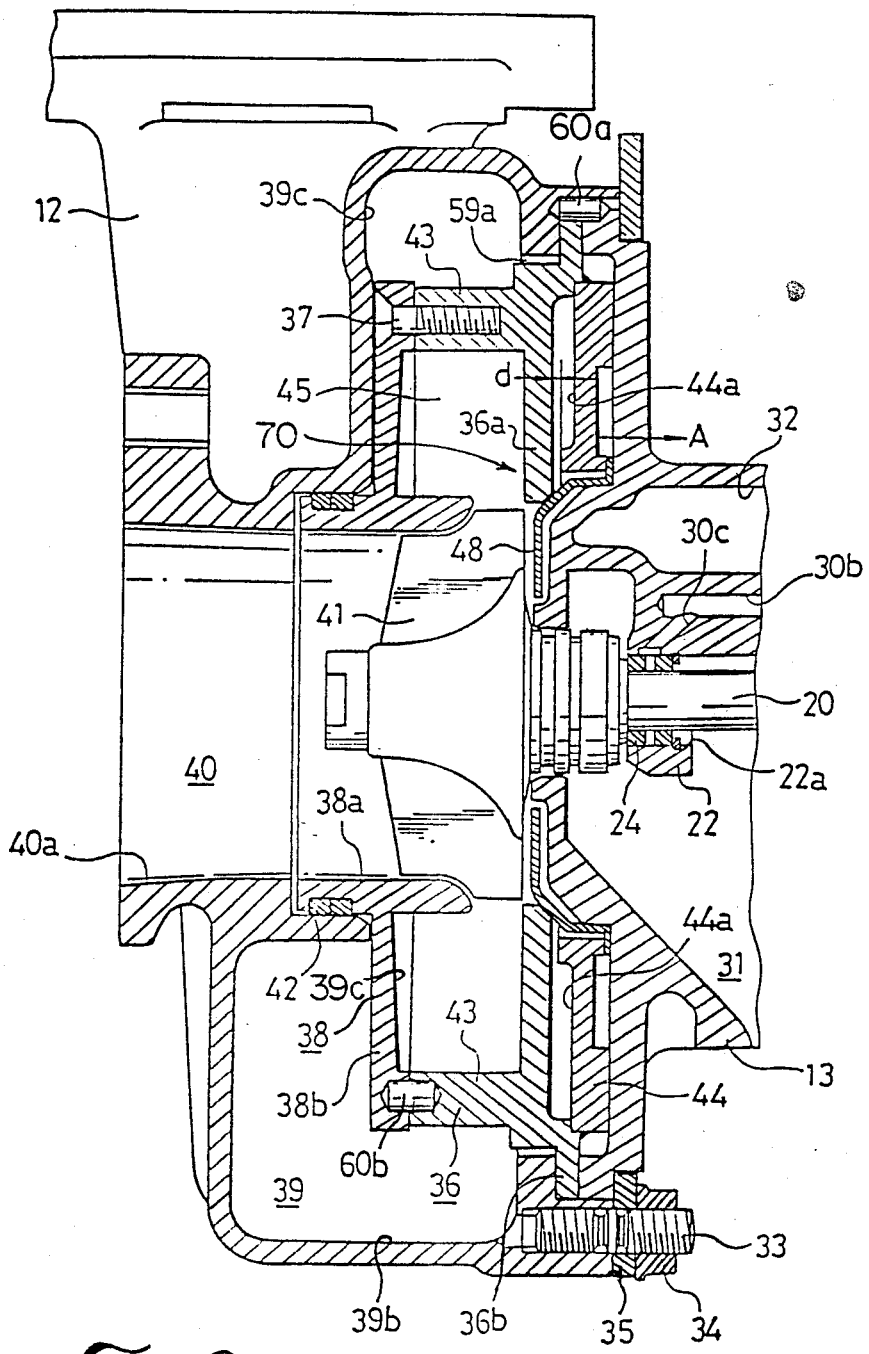
FIG. 9 is a fragmentary axial cross-sectional view of a turbocharger according to still another embodiment of the present invention.

According to still another embodiment shown in FIG. 9, the vane holder 36 (base plate) has no annular boss corresponding to the annular boss 36c shown in FIGS. 1 and 8, but has the flange 36b clamped between the turbine casing 12 and the central casing 13. The thermal insulation plate 44 (back plate) has its outer peripheral edge welded to the axial end surface of the vane holder 36 (base plate) which faces the thermal insulation plate 44 (back plate). The thermal insulation plate 44 is held against the central casing 13. The outer peripheral surface of the disc portion 36a of the vane holder 36 is radially spaced from the inner peripheral surface of the turbine casing 12 by the clearance 59a, but the outer peripheral surface of the flange 36b is held against the inner peripheral surface of the turbine casing 12 without any clearance.

The axial end surface of the vane holder 36 (base plate) which faces the thermal insulation plate 44 (back plate) near the radially inner edge thereof is spaced from the radially inner edge of the thermal insulation plate 44 (back plate) by a gap or clearance d. The thermal insulation plate 44 (back plate) is urged resiliently toward the central casing 13 in the direction of the arrow A so that the inner peripheral edge of the thermal insulation plate 44 (back plate) is hermetically held in contact with the central housing 13 with the shield 48 interposed therebetween.

The gap d between the vane holder 36 and the thermal insulation plate 44 (back plate) and the spacing between the vane holder 36 (base plate) and the central casing 13 are effective in absorbing thermal strain of the vane holder 36 which is heated by exhaust gases flowing through the inner passageway 39*c*. Therefore, the clearance of the nozzle between the cylindrical portion 38*a* and the vane holder 36 (base plate) is not varied. The vane holder 36 does not interfere with the movable vanes 45, which are thus allowed to operate smoothly. Since the thermal insulation plate 44 (back plate) is hermetically held against the central housing 13, no exhaust gases leak therebetween even when the shroud 70 is cooled and shrunk.

Figure 10:
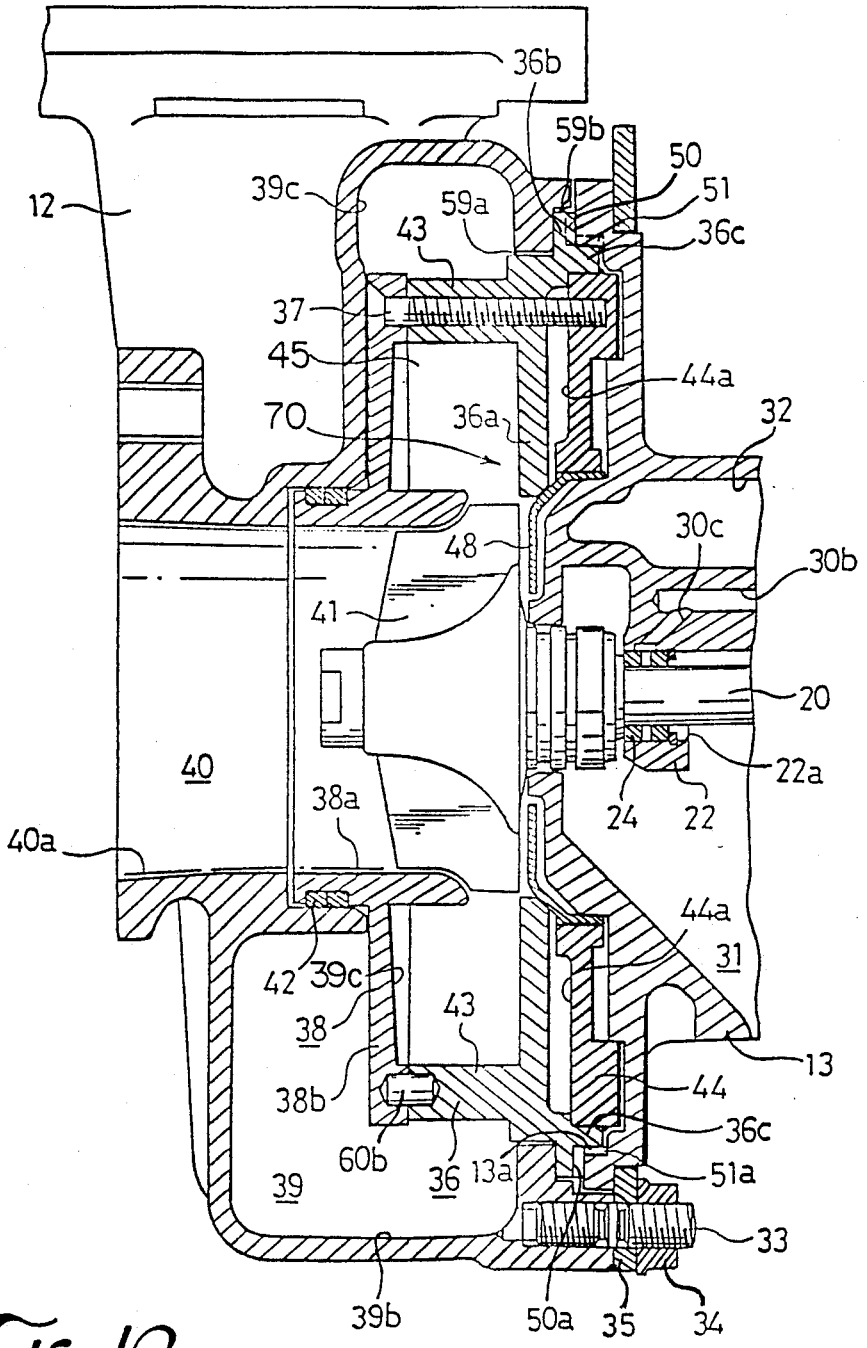
FIG. 10 is a fragmentary axial cross-sectional view of a turbocharger according to a further embodiment of the present invention.
Figure 11:
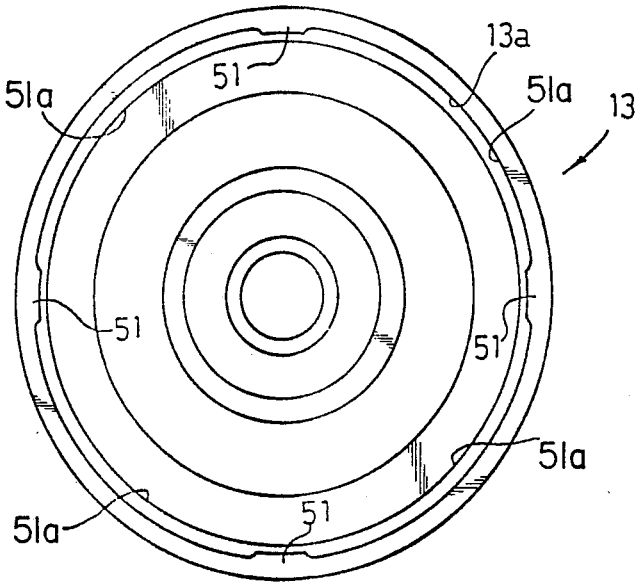
FIG. 11 is a front elevational view of a central casing of the turbocharger shown in FIG. 10.
Figure 12:
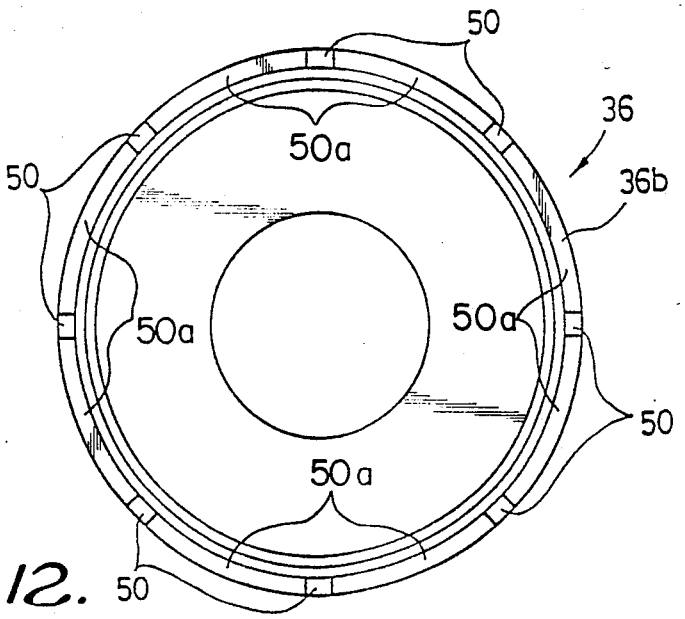
FIG. 12 is a front elevational view of a vane holder of the turbocharger shown in FIG. 10.

FIGS. 10, 11, and 12 show a turbocharger according to a further embodiment of the present invention. The turbocharger of this embodiment is similar to that of FIG. 8 except that the flange 36*b* of the vane holder 36 (base plate) has eight circumferentially equally spaced positioning lands 50 (see FIGS. 10 and 12) projecting axially toward the central casing 13 and held against an axial end surface of the central casing 13. The positioning lands 50 serve to axially position the vane holder 36 (base plate) with respect to the central casing 13, and define therebetween circumferentially equally spaced thermal insulation gaps 50*a* axially between the central casing 13 and the vane holder 36 (base plate).

As illustrated in FIGS. 10 and 11, the central casing 13 has in the positioning recess 13*a* four circumferentially equally spaced positioning lands 51 projecting radially inwardly toward the boss 36*c* of the vane holder 36 (base plate). The positioning lands 51 are held against the outer peripheral surface of the boss 36*c*, and define therebetween circumferentially equally spaced thermal insulation gaps 51*a* radially between the bottom of the positioning recess 13*a* and the outer peripheral surface of the boss 36*c*. The boss 36*c* held against the positioning lands 51 serve to keep the vane holder 36 (base plate) concentric with respect to the central casing 13.

When the turbine casing 12 is thermally expanded during operation of the turbocharger, the vane holder 36 (base plate) concentrically and axially positioned by the positioning lands 50, 51 and the top plate 38 attached to the vane holder 36 (base plate) are prevented from being affected by the thermal expansion of the turbine casing 12. Therefore, the clearance between the top plate 38 and the turbine wheel 41 is maintained at a constant level while the turbocharger is in operation.

The area of contact between the vane holder 36 (base plate) and the central casing 13 is relatively small because they contact each other only through the positioning lands 50, 51 and because the thermal insulation gaps 50*a*, 51*a* are present between the vane holder 36 (base plate) and the central casing 13. Accordingly, the amount of heat that can be transferred from the vane holder 36 (base plate) to the central casing 13 is reduced. The bearing supports 22, 23 are therefore prevented from being heated by the heat of the turbine housing, so that the turbocharger will operate highly reliably.

Although certain preferred embodiments have been shown and described, it should be understood that many changes and modifications may be made therein without departing from the scope of the appended claims.

What is claimed is:

1. A turbocharger comprising:

a compressor housing accommodating a compressor wheel therein;

a turbine housing accommodating a turbine wheel therein, said turbine housing including an annular shroud disposed in surrounding relation to said turbine wheel, said shroud comprised of separate top, base and back plates assembled to cooperate for confining engine exhaust gases around the turbine wheel and with one of said plates having vanes for directing the engine exhaust gases at an outer periphery of the turbine wheel to drive the turbine wheel;

a central housing disposed between and interconnecting said compressor and turbine housings;

a shaft rotatably supported in said central housing by bearings disposed therein, said compressor and turbine wheels being mounted on respective opposite ends of said shaft; and positioning means held in interfitting engagement with said shroud and said central housing for positioning said shroud with respect to said central housing.

2. A turbocharger according to claim 1, wherein said turbine housing also includes a turbine casing in which said shroud is fitted, with clearances left between said turbine casing and said shroud, said turbine casing having a scroll passage for directing exhaust gases into said shroud.

3. A turbocharger comprising:

a compressor housing accommodating a compressor wheel therein;

a turbine housing accommodating a turbine wheel therein, said turbine housing including an annular shroud disposed in surrounding relation to said turbine wheel;

a central housing disposed between and interconnecting said compressor and turbine housings;

a shaft rotatably supported in said central housing by bearings disposed therein, said compressor and turbine wheels being mounted on respective opposite ends of said shaft;

positioning means held in interfitting engagement with said shroud and said central housing for positioning said shroud with respect to said central housing; and wherein said shroud includes a base plate and a back plate mounted thereon, said base plate having a disc portion, an outer peripheral flange extending radially outwardly from said disc portion, and an annular boss extending axially from a radially outer peripheral edge of said disc portion, said central housing having a positioning recess defined in an axial end surface.

4. A turbocharger according to claim 3, wherein said disc portion and said outer peripheral flange are radially spaced from inner peripheral surfaces, respectively, of said turbine casing by respective radial clearances.

5. A turbocharger according to claim 3, wherein said turbine housing also includes a top plate mounted on said base plate and spaced from said turbine casing by a clearance.

6. A turbocharger according to claim 1, wherein said turbine housing also includes a turbine casing in which said shroud is fitted, said turbine casing having a scroll passage for directing exhaust gases into said shroud, said base plate being adjacent to said turbine casing and said back plate mounted on said base plate adjacent to said central housing, said base plate having a disc portion and an outer peripheral flange extending radially outwardly from said disc portion, said positioning means comprising said outer peripheral flange being clamped between said turbine casing and said central housing.

7. A turbocharger according to claim 6, wherein said base plate and said back plate are axially spaced at their inner peripheral edges from each other by a clearance, said inner peripheral edge of said back plate being hermetically held against said central housing, said inner peripheral edge of said base plate being spaced from said central housing.

8. A turbocharger according to claim 7, wherein said inner peripheral edge of said back plate being resiliently urged into contact with said central housing.

9. A turbocharger according to claim 7, further including a heat insulator shield interposed between said inner peripheral edges of said base and back plates and said central housing for reducing heat transfer from said turbine housing to said central housing.

10. A turbocharger according to claim 6, wherein said base plate and said back plate define a thermal insulation space therebetween.

11. A turbocharger according to claim 6, wherein said disc portion is radially spaced from an inner peripheral surface of said turbine casing by a radial clearance.

12. A turbocharger comprising:

a compressor housing accommodating a compressor wheel therein;

a turbine housing accommodating a turbine wheel therein, said turbine housing including an annular shroud disposed in surrounding relation to said turbine wheel;

a central housing disposed between and interconnecting said compressor and turbine housings;

a shaft rotatably supported in said central housing by bearings disposed therein, said compressor and turbine wheels being mounted on respective opposite ends of said shaft;

positioning means held in interfitting engagement with said shroud and said central housing for positioning said shroud with respect to said central housing; and wherein said positioning means comprises a plurality of circumferentially spaced positioning lands radially projecting on one of said shroud and said central housing and held against the other of said shroud and said central housing, said positioning lands defining gaps circumferentially therebetween.

13. A turbocharger according to claim 12, wherein said shroud includes a base plate having a disc portion and an annular boss extending axially from an radially outer peripheral edge of said disc portion, said central housing having a positioning recess defined in an axial end surface facing said turbine housing, said positioning lands being disposed on a radially inner peripheral surface of said central housing and held against said annular boss.

14. A turbocharger according to claim 12, further including a plurality of circumferentially spaced, positioning lands axially projecting on one of said shroud and said central housing and held against the other of said shroud and said central housing, said positioning lands defining gaps circumferentially therebetween.

15. A turbocharger according to claim 14, wherein said shroud includes a base plate having a disc portion and an outer peripheral flange extending radially outwardly from said disc portion, said positioning lands being disposed on said outer peripheral flange and held against an axial end surface of said central housing.

* * * * *

UNITED STATES PATENT AND TRADEMARK OFFICE

CERTIFICATE OF CORRECTION

PATENT NO. : 4,907,952

DATED : March 13, 1990

INVENTOR(S) : Kazuo Inoue et al.

It is certified that error appears in the above-identified patent and that said Letters Patent is hereby corrected as shown below:

Column 14, line 66 after "surface" insert --facing said turbine housing, said positioning means comprising said annular boss fitted in said positioning recess--

Signed and Sealed this

Ninth Day of June, 1992

*Attest:*

DOUGLAS B. COMER

*Attesting Officer*

*Acting Commissioner of Patents and Trademarks*